US005967344A

United States Patent [19]

Liberati

[11] Patent Number: 5,967,344

[45] Date of Patent: Oct. 19, 1999

[54] MIRRORED COAT RACK

[76] Inventor: Morris Liberati, 11 N. 195 Lamont Ct., Elgin, Ill. 60123

[21] Appl. No.: 09/003,401

[22] Filed: Jan. 6, 1998

[51] Int. Cl.[6] ..... A47F 5/00

[52] U.S. Cl. ..... 211/87.01; 211/32; 248/304; 312/227

[58] Field of Search ..... 211/32, 106.01, 211/86.01, 87.01, 30; 248/304; 312/224, 225, 226, 227; D6/300, 301

[56] References Cited

U.S. PATENT DOCUMENTS

| | | | |
|---|---|---|---|
| 72,867 | 12/1867 | Lavater | 248/304 |
| 121,171 | 11/1871 | Huckins | 248/304 X |
| 380,602 | 4/1888 | Simmons et al. | 211/32 X |
| 906,537 | 12/1908 | Lawson | 248/304 |
| 1,908,831 | 5/1933 | Edward | 312/227 |

*Primary Examiner*—Robert W. Gibson, Jr.
*Attorney, Agent, or Firm*—Edward D. Manzo

[57] ABSTRACT

A mirrored coat rack is wall mountable or door mountable and includes one or more coat hooks affixed to a mirrored member made of mirrored glass, mirrored acrylic, or polished metal. A backing member behind the mirrored member adds stability.

10 Claims, 1 Drawing Sheet

MIRRORED COAT RACK

BACKGROUND OF THE INVENTION

The present invention relates to racks, and specifically coat racks, of the type that are hung on a wall (partition or divider) or behind a door in an office or other business establishment.

BACKGROUND OF THE INVENTION

The present invention provides an additional function to an object found in most offices, namely a coat hanger that is attached to the back of a door or on the face of a wall (partition or divider) and adds a feature that has both functional and decorative aspects.

When people arrive at their offices from home, they often desire to check their appearance in a mirror, and adjust their hair, apply makeup, or the like. This desire arises also in advance of meetings, or when departing the premises. There is, from time to time, a need for a mirror with regard to contact lens usage also.

It has been impractical or socially unacceptable, however, to add a mirror as a desk accessory. One does not normally find a mirror in the modern business environment, on a person's desk or work area.

Consequently, prior to this invention, office workers for decades have generally needed to visit the lounge or lavatory to find a mirror for this purpose. This takes time away from the employer.

The present invention accordingly seeks to overcome this inconvenience circumstance and take advantageous use of other equipment that is found in a normal office environment.

SUMMARY OF THE INVENTION

According to the present invention, when practiced in its preferred form, a coat hanger is formed by one or more hooks supported by a planar member, which may be square, rectangular, circular, or another shape, where the planar member includes a mirrored surface.

Advantageously, a backer board can be included to impart stability to the planar member, although this is not a necessary feature.

BRIEF DESCRIPTION OF THE DRAWINGS

The present invention will be understood more fully by reference to the following description of a preferred embodiment with reference to accompanying drawings wherein.

DESCRIPTION OF THE PREFERRED EMBODIMENT

Figure 1:
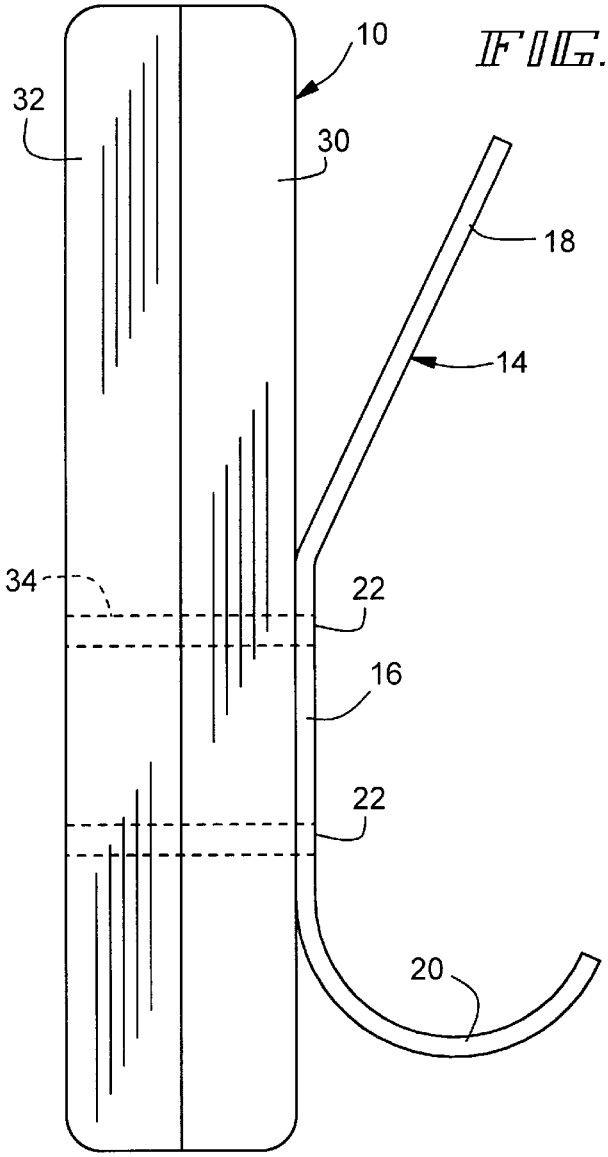
FIG. 1 represents a side elevation of a mirrored coat rack according to the present invention.
Figure 2:
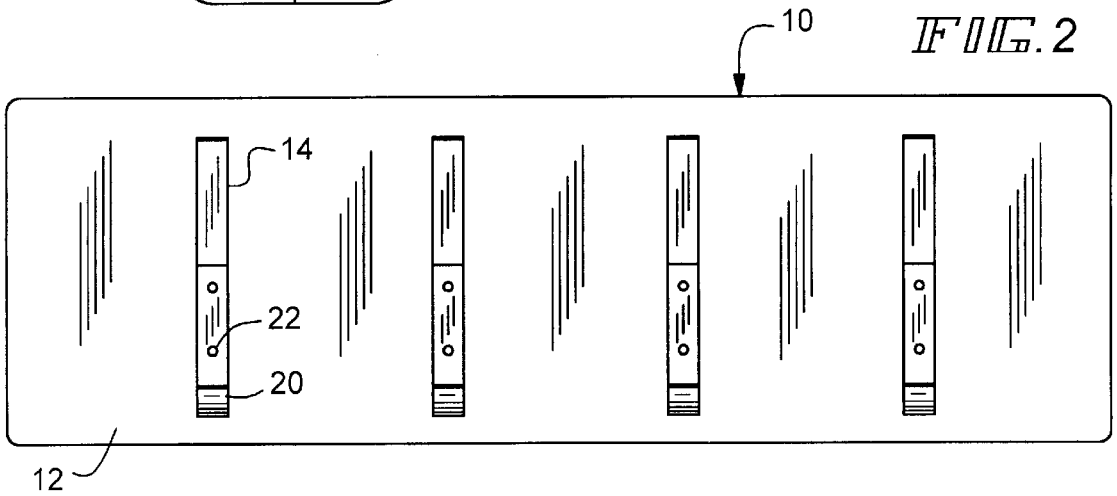
FIG. 2 represents a front view of a mirrored coat rack according to the present invention.

Referring to FIGS. 1 and 2 a mirrored coat rack assembly 10 comprises a planar member 12 containing one or more coat hooks 14. In FIG. 2, four coat hooks 14 are illustrated, but it will be understood that any desired number could be included based on the size of assembly 10 space constraints and market considerations. Hook 14 in one embodiment has a rear riser 16. At the top portion of riser 16, a top angled portion 18 extends away from assembly 10 at an constant angle. At the lower portion of riser 16, a curved portion 20 extends away from assembly 10. Such hooks are well known and need not be described in detail. They may be fabricated of durable material such as brass, steel, aluminum, any common or base metal, Lucite, or other plastic. Other shapes may be used as is convenient. Hook 14 may be affixed to assembly 10 by means of screws or other connectors through holes 22.

Assembly 10 includes a mirrored surface. Illustratively, this may comprise a mirrored glass 30, although a mirrored acrylic member 30 may be preferred. Preferably, but not necessarily, a backing member 32 is affixed behind member 30. Backing member 32 may have substantially the same size as member 30, or may be smaller. Backing member 32 may be made of wood, plastic, or metal, or another suitable material.

Backing member 32 may be affixed to mirrored member 30 either by an adhesive or a mechanical fastener such as screws or bolts which extend through holes 22 and 34. Alternatively, holes can be provided through members 30 and 32, directly beneath member 16. Such holes would be countersunk on the front surface of member 30 so that a screw or bolt head would then be covered by coat hook 14 when it becomes instead on assembly 10. Many suitable assembly methods can be employed which will present a mirrored surface to the user of the coat hook. It is not required that the mirrored surface be at the front surface of member 30, or the rear thereon but a mirrored surface must be presented to the user. Preferably, the mirrored surface is co-extensive with the front face of member 30.

Typically, the assembly 10 for a four-hook rack will be on the order of 24" to 28" wide and about 6" high, with nearly 7" between adjacent hooks. A two-hook version may be about 12" to 14" wide, about 6" high, and have about 6" to 7" spacing between hooks. The front (mirrored) member may be a 0.25" colorless acrylic. The back plate for a 4-hook coat rack may be 24" wide and 4" high, and the back plate for a 2-hook rack may be 1.5" narrower than the mirrored part and 2" shorter. Each hook 14 may be about 6" to 6.5" tall and 0.75" wide. A 35 degree angle between member 18 and riser 16 is suitable. All of these dimensions are nominal and my be varied in application.

A wall mounting apparatus is preferably provided on the assembly. This may be in the form of through holes to secure the assembly to a door or wall or partition/divider or apertures in the backing member to engage fasteners affixed to the wall or partition/divider door (e.g. butterfly connectors or molly screws).

It will be understood that numerous modifications may be made within the scope of the present invention, without departing from the scope and spirit of the invention, which is defined by the following claims.

I claim:

1. A mirrored coat rack comprising:

a substantially planar mirrored member;

at least one coat hook affixed to said mirrored member; and a backing member affixed behind said mirrored member and said at least one coat hook.

2. The coat rack of claim 1 wherein said mirrored member is flat.

3. The coat rack of claim 2 wherein said mirrored member is rectangular.

4. The coat rack of claim 1 wherein said coat rack is wall-mountable or door mountable.

5. The coat rack of claim 4 wherein said at least one coat hook comprises a plurality of hooks.

6. The coat rack according to claim 1 wherein said mirrored member mirror is made from a material selected from glass, acrylic, and polished metal.

7. A coat rack comprising:

a wall-mountable or door-mountable mirror assembly presenting a mirrored surface to a user who is positioned in front of said mirrored assembly and comprising a first member selected from mirrored glass, mirrored acrylic, and polished metal, and a second member affixed to said first member; and a plurality of coat hooks located on said mirrored surface and affixed to said mirror assembly.

8. The coat rack of claim 7 wherein said second member comprises a flat backing member providing stability to said first member.

9. The coat rack according to claim 8 further comprising a plurality of through holes extending from said plurality of coat hooks through said mirror assembly.

10. A coat rack comprising:

a rigid mirrored assembly having a backing member and a fastener apparatus to permit securing the assembly to a wall or hinged door said mirrored assembly having a mirrored surface;

a plurality of coat hooks; and means securing said coat hooks to said mirrored assembly so that said coat hooks are located on said mirrored surface.

* * * * *